US008144907B2

(12) United States Patent
Reithinger et al.

(10) Patent No.: US 8,144,907 B2
(45) Date of Patent: Mar. 27, 2012

(54) WATER-RESISTANT HEARING DEVICE

(75) Inventors: Jürgen Reithinger, Neunkirchen am Brand (DE); Christian Weistenhöfer, Bubenreuth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 507 days.

(21) Appl. No.: 12/322,623

(22) Filed: Feb. 5, 2009

(65) Prior Publication Data

US 2009/0208045 A1 Aug. 20, 2009

Related U.S. Application Data

(60) Provisional application No. 61/028,946, filed on Feb. 15, 2008.

(30) Foreign Application Priority Data

Feb. 15, 2008 (DE) ..... 10 2008 009 284

(51) Int. Cl.
*H04R 1/00* (2006.01)

(52) U.S. Cl. ..... 381/322; 381/71.1

(58) Field of Classification Search ..... 381/322, 381/71.1

See application file for complete search history.

(56) References Cited

U.S. PATENT DOCUMENTS

| | | | | |
|---|---|---|---|---|
| 3,337,841 | A * | 8/1967 | Wainwright et al. | 367/132 |
| 7,684,576 | B2 * | 3/2010 | Bank et al. | 381/190 |

FOREIGN PATENT DOCUMENTS

| | | | |
|---|---|---|---|
| DE | 112006000463 | T5 | 1/2008 |
| EP | 1799009 | A1 | 6/2007 |
| JP | 09215098 | A | 8/1997 |
| JP | 2004227980 | A | 8/2004 |
| JP | 2004235870 | A | 8/2004 |
| WO | 9325053 | A1 | 12/1993 |
| WO | WO 2006/090545 | A1 | 8/2006 |

OTHER PUBLICATIONS

Hillenbrand et al., "Piezoelectret microphones with high sensitivity", Electrets, 2005, ISE-12. 2005 12th International Symposium on Salvador, Bahia, Brazil, Sep. 11-14, 2005, Piscataway, NJ, USA, IEEE, Sep. 11, 2005, pp. 125-128, XP010905727, DOI: Doi: 10.1109/ISE.2005.1612334, ISBN:978-0-7803-9116-1.

* cited by examiner

*Primary Examiner* — Jasmine Clark

(57) ABSTRACT

The invention relates to a water-resistant hearing device, which has the following: At least one first electroacoustic transducer for receiving sound waves and converting said sound waves into electrical signals, an electronic circuit sealed against liquids by coating and/or encapsulation, at least one second electroacoustic transducer converting electrical signals supplied to the circuit into sound waves and an electrical energy source sealed against liquids by means of coating and/or encapsulation. In this way the electroacoustic transducers are made of materials which realize a deformation in an electrical and/or magnetic field and/or an electrical current flow and/or an electrical voltage (and/or vice versa) and are insensitive to liquids, in particular water, salt water and slight acids.

13 Claims, 1 Drawing Sheet

WATER-RESISTANT HEARING DEVICE

CROSS REFERENCE TO RELATED APPLICATIONS

The present application claims the benefit of a provisional patent application filed on Feb. 15, 2008, and assigned application No. 61/028,946. The present application also claims the benefit of a German application No. 10 2008 009 284.3 filed Feb. 15, 2008. Both of the applications are incorporated by reference herein in their entirety.

FIELD OF THE INVENTION

The invention relates to a water resistant hearing device.

BACKGROUND OF THE INVENTION

Hearing devices are used to compensate for reductions in the hearing ability of patients. Hearing devices consist of one or more microphones, an electronic circuit, which comprises at least one analog or digital amplifier, and one or more loudspeakers as well as an energy source for supplying these components.

During practical use, hearing devices are constantly exposed to liquid and contamination influences. These influences may have different causes; on the one hand patient perspiration and cerumen formation, on the other hand environmental influences such as dust or the effect of water when swimming or undertaking other types of water sport for instance, or if the patient carelessly drops the hearing device into a vessel filled with water or another liquid.

To prevent damage to or destruction of the hearing device as a result of water ingress and thus electrical short-circuits frequently associated therewith, hearing devices were previously designed to be water-tight so that water ingress can not take place. The disadvantage of this is for instance that complicated membrane arrangements are needed in the region of the microphone and loudspeaker in order to seal these regions and allow transmission of sound waves from/to outside the hearing device in such cases.

It is thus an object of the present invention to specify a hearing device in which it is possible to dispense with a water-tight design.

SUMMARY OF THE INVENTION

This object is achieved in accordance with the invention by a hearing device, which has the following: At least one first electroacoustic transducer for receiving sound waves and converting said sound waves into electrical signals, an electronic circuit for processing the electrical signals which is sealed against liquids by means of coating and/or encapsulation, at least one second electroacoustic transducer for converting electrical signals supplied by the circuit into sound waves and an electrical energy source which is sealed against liquids by coating and/or encapsulation.

In the invention, the electroacoustic transducers are made of materials which convert a change of shape into an electrical and/or magnetic field and/or an electrical current flow and/or an electrical voltage (and/or vice versa) and which are insensitive to liquids, in particular water, salt water and slight acids.

In this way, all components of the hearing device, i.e. the at least two transducers (e.g. microphone and loudspeaker), the electronic circuit, which is used for the signal processing and signal amplification, and the energy source (e.g. battery or accumulator) are insensitive to water influences in each instance and this does not depend on the housing. In particular, the housing does not need to be embodied in a water-tight fashion, correspondingly complicated measures can advantageously be omitted.

Provision is made in one exemplary embodiment to design the housing such that liquid which has reached the interior of the housing, in particular water, can drain off. This ensures on the one hand that liquid which has unintentionally reached the inside of the housing can drain off and on the other hand enables the hearing device to be rinsed with water or other liquids and to be cleaned in this way.

Single or multilayer piezoelectret films and/or piezoelectrical transducers, for instance a flexural vibrator or thickness vibrator, are particularly suited to the design of the electroacoustic transducer.

The electroacoustic transducer(s) functioning as (a) microphone(s) can alternatively be embodied as hot-wire microphone(s). Hot-wire microphones potentially malfunction if they are immersed in liquids, but do not suffer damage as a result thereof and are operational again once the liquid has drained off.

BRIEF DESCRIPTION OF THE DRAWINGS

Exemplary embodiments of the present invention are described in more detail below with reference to 3 Figures, in which.

DETAILED DESCRIPTION OF THE INVENTION

Figure 1:
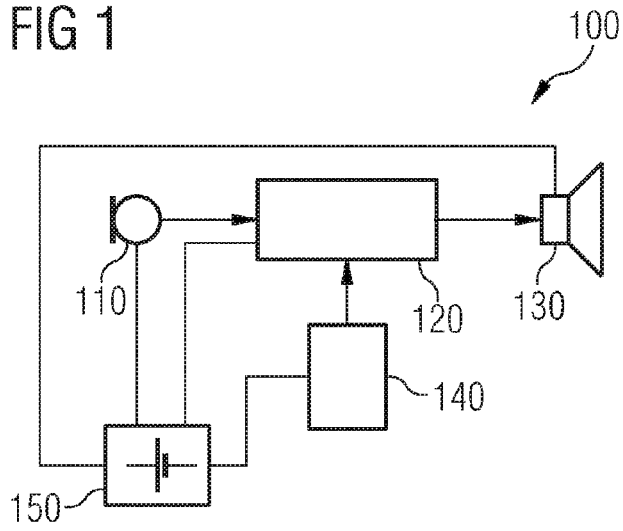
FIG. 1 shows a schematic representation of the block diagram of a hearing device.

FIG. 1 shows a schematic representation of the block diagram of a hearing device 100 with a first electroacoustic transducer and/or microphone 110 for receiving an acoustic input signal (sound waves) and converting said sound signal into an electrical signal, a signal processing unit 120 and a second electroacoustic transducer and/or receiver 130 for converting an electrical signal output by the signal processing unit 120 into an acoustic output signal.

A programmable control unit 140 can optionally be provided, which controls the signal processing unit 120 and contains executable programs as well as setting parameters for the signal processing unit 120. These programs and parameters are used to adjust the behavior of the signal processing unit 120 (and thus the behavior of the hearing device 100) to different hearing damages as well as to different auditory situations. The signal processing unit 120 and control unit 140 can naturally be combined in a common electronics system (not shown).

An electrical energy source 150 is used to supply electrical energy.

According to the present invention, the electronic circuit(s) 120, 140 and the energy source 150 are protected against the effect of liquids by means of coating and/or encapsulation. Liquids which have penetrated the hearing device 100, such as water, may thus not damage these components 120, 140, 150, since the liquids are kept out by the coating and/or the encapsulation compounds and are not able to wet the components 120,140, 150. Patented conductors, which connect the electronic circuit(s) 120, 140 and the energy source 150 to one another are preferably likewise protected against the effect of liquids by means of coating and/or encapsulation.

In conjunction with such a design, the use of an accumulator as an energy source 150 is particularly advantageous if this is combined with wireless charging devices (not shown) which are well-known in the field of technology. Alternatively, high-yield batteries can also be used, the service life of which is then to correspond approximately to the overall service life of the hearing device 100.

A water-resistant embodiment is preferred for the electroacoustic transducer 110, 130, i.e. a design which, as a result of its structure and/or the materials used, can not be damaged by contact with liquids, so that a seal can be omitted. To this end, materials can preferably be used, which convert a change of shape into an electrical and/or magnetic field and/or an electrical current flow and/or an electrical voltage (and/or vice versa) and which are insensitive to liquids.

Figure 2:
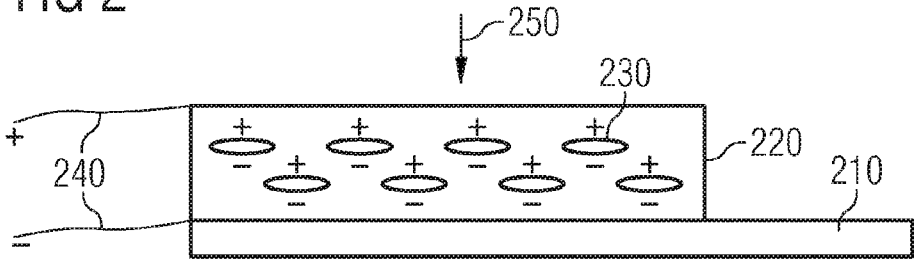
FIG. 2 shows a schematic representation of an embodiment of an electroacoustic transducer for use in conjunction with a hearing device.

FIG. 2 shows a schematic representation of a first embodiment of an electroacoustic transducer. A piezoelectret film 220 is applied to a housing section 210. Piezoelectret films are electrically polarized plastic films (electrets) which contain many flat bubbles 230 in their interiors. Polarized charges are located on the boundary surfaces of these bubbles, so that many small capacitors are produced. The resilience of the air (or another gas) in the bubbles is essentially less than the resilience of the film, so that the film can be expanded and compressed in respect of its thickness. When the film is used as a sensor or a microphone, a voltage can then be tapped off in response to an acoustic signal 250 on the surfaces of the film by means of electrodes. Conversely, a voltage applied to the electrodes 240 then results in the thickness of the film changing, so that an acoustic signal can be generated with a corresponding actuation. With an electroacoustic transducer according to FIG. 2, it is possible to advantageously dispense with a complicated mechanical system and in the case of a suitable embodiment, also with a return volume.

An electroacoustic transducer which is made of a piezoelectret film is particularly suited both as a microphone 110 and also as a receiver 130. Except for the electrodes 240, such a film transducer does not offer any components which can be attacked by (non or slightly corrosive) liquids, so that a water-resistant electroacoustic transducer 110, 130 is present after suitably coating the electrodes, with said transducer not being damaged by contact with liquids and with it being possible for said transducer not to be damaged and thus having to be sealed. It is possible instead to rinse the transducer with water inter alia, and the transducer once again functions normally after the drying process. Such a transducer also functions in the wet state, however this may also result in frequency distortions and losses in the degrees of efficiency. Such a transducer is also largely insensitive to mechanical stresses.

Alternatively, classical piezoelectric transducers can also be used as electroacoustic transducers 110, 130, which are likewise water-resistant, but are disadvantageous in that they operate less efficiently and at the same time exhibit a higher sensitivity to mechanical stresses and solid-borne sound. Examples of such piezoelectric transducers are flexural vibrators and thickness vibrators.

A microphone 110 structured using piezoelectret films in accordance with FIG. 2 is also advantageous, in addition to the water insensitivity already explained in detail, in that it is insensitive to solid-borne sound. If applicable, a larger surface needs to be provided compared with conventional microphones in order to achieve adequate acoustic sensitivity.

If piezoelectric flexural vibrators are used as microphone 110 in accordance with an alternative exemplary embodiment, it may be advantageous to provide two distanced microphones of this type in order to be able to compensate for the effect of solid-borne sound on the microphone and to isolate the airborne-sound as the signal of interest.

In a further alternative exemplary embodiment, a hot-wire microphone is used as a microphone 110. Hot-wire microphones do not detect the air vibrations, but instead the air flow across one or more heated wires, by measuring the change in the resistance of the wire and or wires, which results from the cooling effect of the more or less strong air flow, with the intensity of the air flow depending in turn on the incident sound waves. Such a microphone is in principle also well suited to use in conjunction with a hearing device. The energy consumption (in particular for the heating of the wire and/or wires) which is higher compared with other microphone types, plays no role, provided the hearing device is supplied by a wirelessly rechargeable battery, because this can then be conveniently charged overnight for instance.

Similarly, hot-wire microphones do not suffer any damage as a result of water contact, but certainly fail if contact with water continues. As soon as the water has drained off, the hot-wire microphone functions normally again. Hot-wire microphones can thus also be effectively cleaned.

The housing (not shown) of a microphone 110 preferably has two openings, in order to render the microphone 110 rinseable in a problem free fashion and in particular, after a desired or undesired contact with liquid, so that that the liquid contact can be easily dried again. A microphone with such a housing has a directional characteristic, which, by means of a corresponding design of the housing, can be advantageously used for the preferable detection of acoustic signals from a preferred direction.

Figure 3:
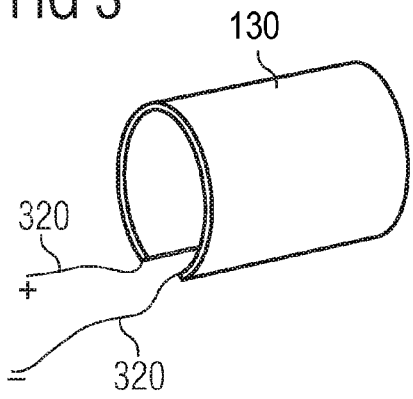
FIG. 3 shows an additional embodiment of an electroacoustic transducer for use in conjunction with a hearing device.

FIG. 3 shows a schematic representation of an embodiment of an electroacoustic transducer on the basis of a piezoelectret film for use as a receiver 130 of a hearing device. The transducer has a piezoelectret film, which essentially takes the form of a hollow cylindrical segment and which is either held in this form by a housing (not shown) or by its own mechanical properties. Terminals 320 are used to supply electrical signals, which are then converted by the film receiver into acoustic signals. Such a receiver is primarily suited for use in the auditory canal of the hearing device wearer.

With the above-mentioned measures and components, it is easily possible to construct a hearing device, the housing (not shown) of which does not have to be embodied to be watertight. Instead, an open housing can be embodied, wherein the hearing device is as a whole light, cost-effective and in particular also easy to clean. In addition pressure equalization does not present any problems in an open design, unlike in closed and sealed systems, where it represents a considerable problem.

The invention claimed is:

1. A hearing device, comprising:

a first electroacoustic transducer that is made of a first material and converts sound waves into electrical signals;

an electronic circuit that is sealed for against a liquid and processes the electrical signals;

a second electroacoustic transducer that is made of a second material and converts the processed electrical signals into sound waves; and an electrical energy source that is sealed for against the liquid and supplies a power, wherein the first material and the second material are configured to be insensitive to the liquid so that a seal of the first electroacoustic transducer and a seal of the second electroacoustic transducer for not contacting with the liquid are omitted.

2. The hearing device as claimed in claim 1, wherein the first electroacoustic transducer or the second electroacoustic transducer comprises a layer of piezoelectret films that is applied to a housing of the hearing device, wherein the layer of piezoelectret films is configured to be insensitivity to solid-borne sound.

3. The hearing device as claimed in claim 1, wherein the first electroacoustic transducer or the second electroacoustic transducer is a piezoelectric transducer.

4. The hearing device as claimed in claim 3, wherein the piezoelectric transducer is a flexural vibrator or a thickness vibrator.

5. The hearing device as claimed in claim 1, wherein the first electroacoustic transducer comprises a hot-wire microphone.

6. The hearing device as claimed in claim 1, wherein the first electroacoustic transducer comprises a housing having an opening for draining off the liquid that reaches an interior of the housing.

7. The hearing device as claimed in claim 1, wherein the second electroacoustic transducer comprises a transducer material that is molded to form a hollow cylinder or hollow cylinder segment.

8. The hearing device as claimed in claim 1, wherein the electronic circuit is sealed by a coating or an encapsulation.

9. The hearing device as claimed in claim 1, wherein the electrical energy source is sealed by a coating or a casting.

10. The hearing device as claimed in claim 1, wherein the first electroacoustic transducer converts a change in shape into an electrical, or a magnetic field, or an electrical current flow, or an electrical voltage.

11. The hearing device as claimed in claim 1, wherein the second electroacoustic transducer converts a change in shape into an electrical, or a magnetic field, or an electrical current flow, or an electrical voltage.

12. The hearing device as claimed in claim 1, wherein the liquid comprises water, or salt water, or slight acids.

13. The hearing device as claimed in claim 2, wherein the housing is constructed as an open housing and is not water tight.

* * * * *